US007954467B2

(12) United States Patent
Grunow

(10) Patent No.: US 7,954,467 B2
(45) Date of Patent: Jun. 7, 2011

(54) CAMSHAFT ADJUSTER CONTROL VALVE ARRANGEMENT

(75) Inventor: Lutz Grunow, Berlin (DE)

(73) Assignee: Daimler AG, Stuttgart (DE)

( * ) Notice: Subject to any disclaimer, the term of this patent is extended or adjusted under 35 U.S.C. 154(b) by 610 days.

(21) Appl. No.: 12/009,846

(22) Filed: Jan. 22, 2008

(65) Prior Publication Data

US 2008/0149056 A1 Jun. 26, 2008

Related U.S. Application Data

(63) Continuation-in-part of application No. PCT/EP2006/006682, filed on Jul. 7, 2006.

(30) Foreign Application Priority Data

Jul. 22, 2005 (DE) ..... 10 2005 034 275

(51) Int. Cl.
*F01L 1/34* (2006.01)

(52) U.S. Cl. ..... 123/90.17; 123/90.15; 464/160

(58) Field of Classification Search ..... 123/90.15, 123/90.16, 90.17, 90.18; 137/511; 464/1, 464/2, 160
See application file for complete search history.

(56) References Cited

U.S. PATENT DOCUMENTS 6,182,622 B1 * 2/2001 Goloyatai-Schmidt et al. ..... 123/90.15

FOREIGN PATENT DOCUMENTS

| | | |
|---|---|---|
| DE | 198 17 319 | 10/1999 |
| DE | 198 48 706 | 4/2000 |
| DE | 199 08 146 | 8/2000 |
| EP | 1 136 656 | 9/2001 |
| WO | WO 2005/113943 | 12/2005 |

* cited by examiner

*Primary Examiner* — Ching Chang
(74) *Attorney, Agent, or Firm* — Klaus J. Bach

(57) ABSTRACT

In a camshaft adjuster control valve arrangement including a valve housing in the form of a central screw, the valve housing has a central passage of essentially constant diameter extending fully through the central screw.

8 Claims, 3 Drawing Sheets

CAMSHAFT ADJUSTER CONTROL VALVE ARRANGEMENT

This is a Continuation-In-Part Application of pending international patent application PCT/ep2006/006682 filed Jul. 7, 2006 and claiming the priority of German patent application 10 2005 034 275.2 filed Jul. 22, 2005.

BACKGROUND OF THE INVENTION

The invention relates to a camshaft adjuster control valve arrangement mounted to the camshaft by a central screw having an axial opening with a camshaft adjusting valve disposed therein.

DE 198 17 319 C2 discloses a camshaft adjuster valve device having a valve housing which is embodied as a central clamping screw. The valve housing has a blind hole in which a control piston is guided. The blind hole ends before a threaded region of the valve housing. In said threaded region, the valve housing is formed from solid material.

It is the object of the present invention to provide a camshaft adjusting valve involving reduced manufacturing expenditures.

SUMMARY OF THE INVENTION

In a camshaft adjuster control valve arrangement including a valve housing in the form of a central screw by which a camshaft adjustment device is mounted to the camshaft, the valve housing has a central passage of essentially constant diameter extending fully through the central screw.

Such an embodiment permits production on a machine tool with few chucking operations, as a result of which the valve housing can be produced in a particularly cost-effective manner. It is possible to use blanks which very closely resemble a subsequent final contour, for example preferably hollow extrusion blanks or rotary swaging blanks, in particular if the passage duct has an at least substantially constant diameter and/or the valve housing has a substantially constant wall thickness at least in a partial threaded region and in at least one partial guiding region. In addition, as a result of the central passage, it is possible to obtain an advantageous chip discharge and cooling of tool cutting edges, and expensive deburring of blind holes at the end of a guide bore receiving a control piston can be avoided. In this context, "substantially identical" is to be understood to mean that slight deviations from the scope of protection should be encompassed, with the deviations preferably being less than 15% and particularly advantageously being less than 10% or in the range of a maximum of one step of an established thread step according to the DIN standard. "Central" is to be understood in particular to mean that the passage duct extends concentrically through the valve housing. In addition, a partial guide region is to be understood to mean an axial section of the valve housing in which a control piston is guided during operation, in particular within the passage duct.

In a further embodiment, the valve housing has substantially an identical outer diameter in at least one partial threaded region and in at least one partial guide region, as a result of which an advantageous force distribution can be obtained, and an elastic transverse contraction of a guide region or of a fit for the control piston upon tightening of the central screw which may result in jamming of the control piston in particular in the end position can be largely avoided, especially if the tolerances are close to their limits.

In a preferred embodiment, the camshaft adjusting valve device has at least one partition means which is fastened in the valve housing, as a result of which a support face for a spring means and in particular a sealing partition can be created in a structurally simple manner with little production expenditure.

It is additionally possible to obtain advantageous designs of the valve housing and/or of the control piston if a non-return valve is fastened in the valve housing. Here, the one-way valve can be formed separately from the partition means or advantageously at least partially in one piece with the latter, as a result of which it is possible to save on additional components, installation space, assembly expenditure and costs, specifically in particular if the non-return valve and the partition means are designed as a modular unit which can be mounted in the valve housing.

It is possible for components such as in particular the partition means and/or the non-return valve to be fastened in the valve housing by means of various force-fitting, form-fitting and/or cohesive connections which would appear to a person skilled in the art to be expedient, such as for example by means of adhesive connections, screw connections, clamping connections and/or advantageously by means of crimped connections etc. In the case in particular of fastening by means of a crimped connection, the component which is fastened in the valve housing is preferably pressed into the valve housing from a side which, considered in the installed state, faces toward a camshaft, as a result of which undesired repercussions of the fastening process on guide surfaces of the control piston within the valve housing can be avoided.

In a further embodiment of the invention, the valve housing may have at least one integrally formed securing element for securing a control piston, as a result of which it is possible to save on additional components, installation space, weight, assembly expenditure and costs.

If the valve housing has a profile on an inner periphery, which profile is provided for introducing a torque, such as in particular a polygonal profile etc., it is possible for an advantageous, preferably a cylindrical clamping region to be formed on an outer periphery of the valve housing, so that the valve housing can be simply and advantageously clamped during its manufacture.

The invention will become more readily apparent from the following description thereof on the basis of the accompanying drawings:

DESCRIPTION OF PARTICULAR EMBODIMENTS

Figure 1:
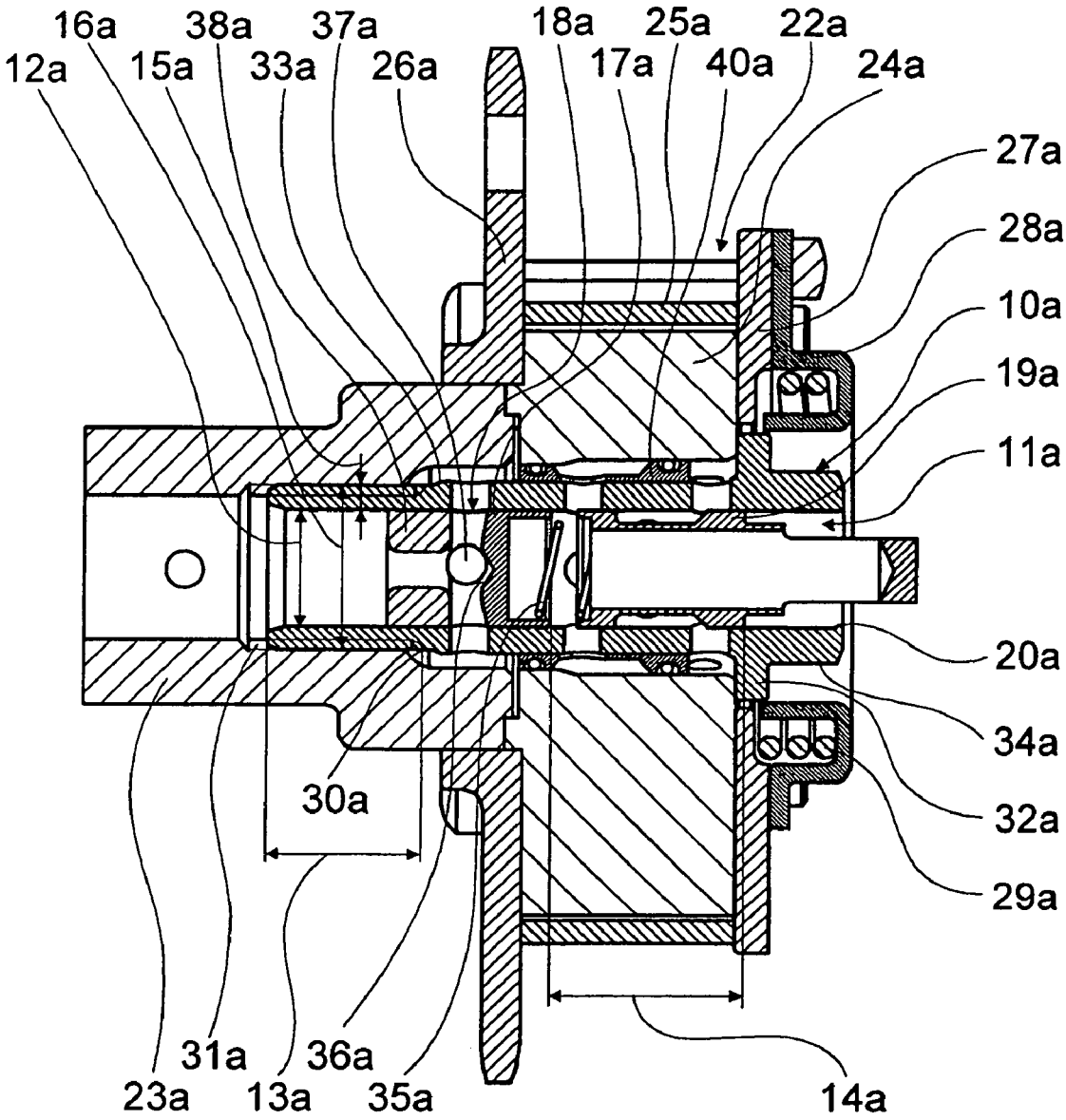
FIG. 1 is a sectional view of a camshaft adjuster with a camshaft adjusting valve device, mounted on a camshaft.

FIG. 1 shows in a sectional illustration a camshaft adjuster 22*a* with a camshaft adjusting valve device according to the invention, mounted on a camshaft 23*a*. The camshaft adjusting valve device has a valve housing 10*a* which is in the form of a central screw and which extends centrally through a vane piston 24*a* which is arranged in a housing 25*a*, is screwed with an external thread 30*a* into an internal thread 31*a* of the camshaft and bears with an integrally formed radial flange 32*a* directly against an end face, which faces away from the camshaft 23*a*, of the vane piston 24*a* and presses the latter against an end face of the camshaft 23*a*, so that said vane piston 24*a* is rotationally fixedly coupled to the camshaft 23*a*. In the radially inner region of the vane piston 24*a*, the valve housing 10*a* is coupled by means of a sealing sleeve 40*a* to the vane piston 24*a*.

Figure 2:
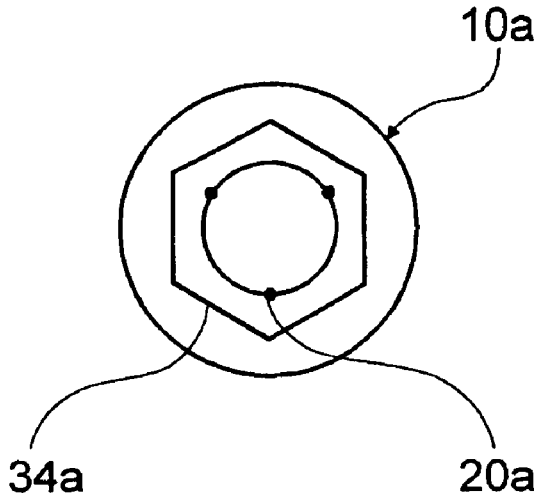
FIG. 2 is a front view of a valve housing shown in FIG. 1.

The valve housing 10*a* has, on that side of the radial flange 32*a* which faces away from the camshaft 23*a*, an external hexagon 34*a* in order to be able to screw said valve housing 10*a* into and out of the internal thread 31*a* of the camshaft 23*a* (FIGS. 1 and 2). Other profiles suitable for a screw connection would alternatively also be conceivable.

At a side facing toward the camshaft 23*a*, the housing 25*a* and the vane piston 24*a* adjoin a sprocket 26*a*, and are closed off at a side facing away from the camshaft 23*a* by a cover 27*a*, on whose side which in turn faces away from the camshaft 23*a* is arranged a spring cover 28*a* with a coil pressure spring 29*a*.

The valve housing 10*a* which is designed as a rotary swaging blank has a central passage 11*a* with a constant diameter 12*a*. Alternatively to a rotary swaging blank, the valve housing 10*a* could also advantageously be formed by an extrusion blank. The valve housing 10*a* also has, in its threaded region 13*a* and in its guiding region 14*a* with the exception of the radial flange 32*a*, a substantially constant wall thickness 15*a* and a substantially constant outer diameter 16*a*. A negligible difference in the wall thickness 15*a* and in the outer diameter 16*a* is given by a small step 33*a* which is of the order of magnitude of an established thread step according to the DIN (Deutsches Institut für Normung [German Institute for Standardization]) standard.

In the guide region 14*a*, a substantially pot-shaped control piston 19*a* is guided within the passage 11*a*, which control piston 19*a* could also be entirely of tubular design. The control piston 19*a* is, on a side facing away from the camshaft 23*a*, designed so as to be adjustable in the axial direction by means of an electromagnetic actuator (not illustrated). Arranged on that side of the control piston 19*a* which faces toward the camshaft 23*a* is a compression coil spring 35*a* which is supported in the direction of the camshaft 23*a* on a partition 17*a* and is fastened in the valve housing 10*a*. The coil pressure spring 35*a* biases the control piston 19*a* in the direction of the electromagnetic actuator (not illustrated). The partition 17*a* is pressed into the valve housing 10*a* from that side which, considered in the installed state, faces toward the camshaft 23*a*. The partition 17*a* is additionally formed partially in one piece with a check valve 18*a* which is fastened in the valve housing 10*a*, that is, a seat 36*a* for a valve ball 37*a* of the non-return valve 18*a* is integrally formed on a side, which faces toward the camshaft 23*a*, of the partition 17*a*. The non-return valve 18*a* comprises, in addition to the valve ball 37*a*, a sleeve 38*a* which is likewise pressed into the valve housing 10*a* from that side which, considered in the installed state, faces toward the camshaft 23*a*. By means of the step 33*a*, it is possible to avoid an undesired bulging in the region of the sleeve 38*a* and of the partition 17*a*.

In order to secure the control piston 19*a* within the valve housing 10*a* or within the passage 11*a*, the valve housing 10*a* has, on its end side facing away from the camshaft 23*a*, in the region of the passage 11*a*, three integrally formed securing elements 20*a* which are distributed uniformly over the periphery, are formed by punch impressions and project radially inward into the passage duct 11*a* (FIG. 2).

Figure 3:
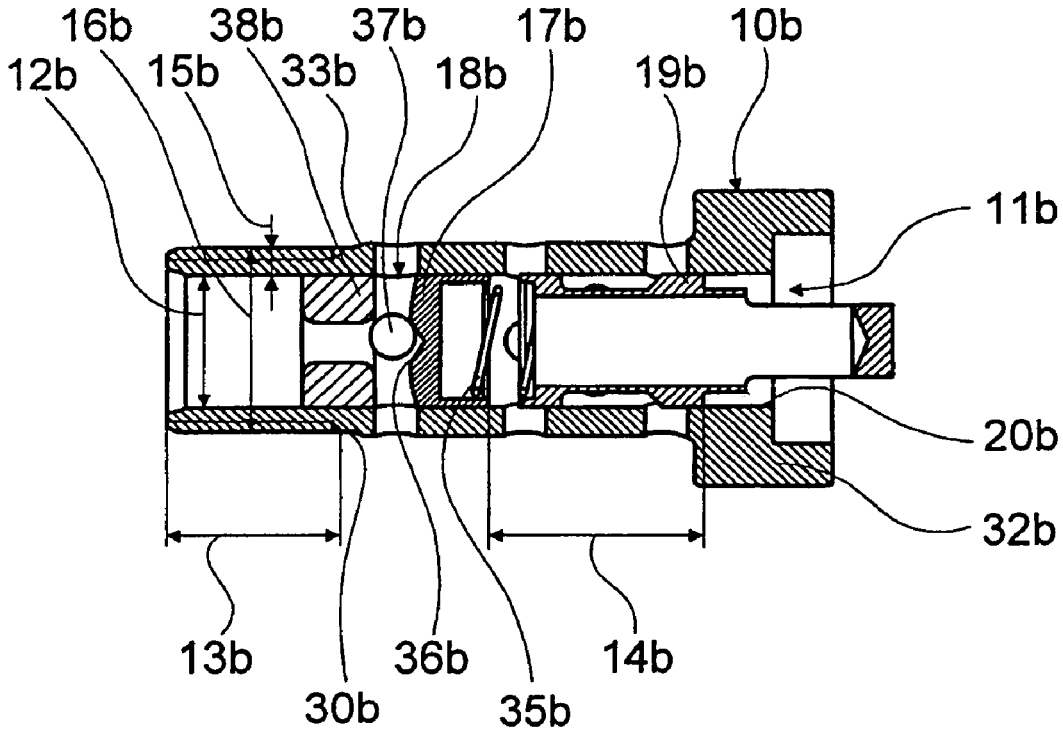
FIG. 3 shows an alternative camshaft adjusting valve device with an internal hexagon.
Figure 4:
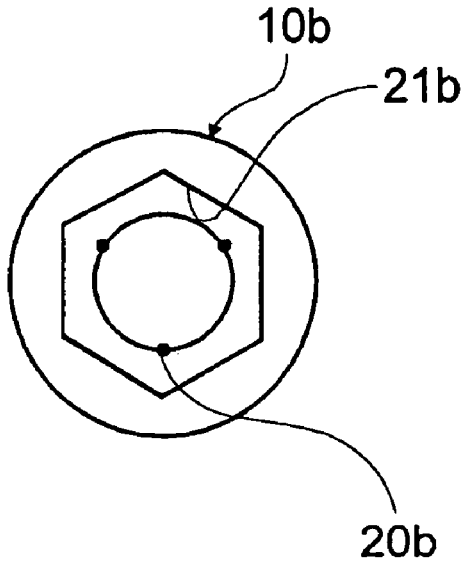
FIG. 4 is a front view of a valve housing from FIG. 3 on its own.
Figure 5:
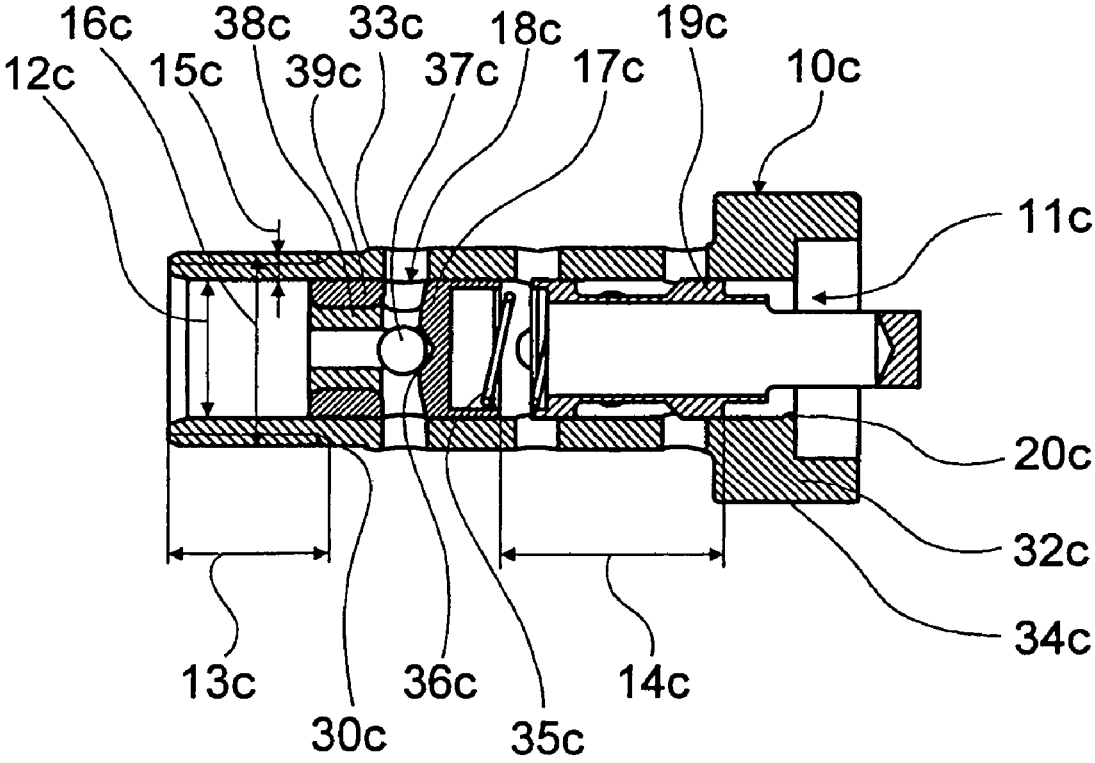
FIG. 5 shows an alternative camshaft adjusting valve device with a non-return valve and a partition means embodied as a modular unit.

FIGS. 3 to 5 illustrate further exemplary embodiments. Substantially identical components are denoted fundamentally by the same reference symbols, with the letters a-c having been added to the reference symbols in order to distinguish the exemplary embodiments. In addition, with regard to identical features and functions, reference can be made to the description with regard to the exemplary embodiment in FIGS. 1 and 2. The following description is restricted substantially to the differences with respect to the exemplary embodiment shown in FIGS. 1 and 2.

FIG. 3 shows a sectional illustration of a camshaft adjusting valve device with a valve housing 10*b*. The valve housing 10*b* has, instead of an external hexagon on an inner periphery, a profile 21*b* which is formed by an internal hexagon (FIGS. 3 and 4). In the region of the internal hexagon, the valve housing 10*b* has, at its outer periphery, a cylindrical contour which serves as a clamping and contact face during the manufacture of the valve housing 10*b*.

FIG. 5 shows a sectional illustration of a camshaft adjusting valve device with a valve housing 10*c* which corresponds to the exemplary embodiment shown in FIG. 3. A control piston 19*c* is again movably supported in a passage 11*c* of the valve housing 10*c*. A partition 17*c* and a non-return valve 18*c* are also fastened in the passage duct 11*c*. The partition means 17*c* and the non-return valve 18*c* are formed partially in one piece and as a modular unit which can be installed in the valve housing 10*c*. The partition 17*c* has, on the side, which, in the installed position, faces away from the control piston 19*c*, an integrally formed tubular projection 39*c* into which a sleeve 38*c*, which retains a valve ball 37*c* of the non-return valve 18*c*, is pressed.

What is claimed is:

1. A camshaft adjuster control valve arrangement comprising a valve housing (10*a*, 10*b*, 10*c*) formed by a central screw, having a central passage (11*a*, 11*b*, 11*c*) of a substantially constant diameter extending fully through the central screw, at least one partition (17*a*, 17*b*, 17*c*) disposed in the central passage (11*a*, 11*b*, 11 *c*) of the valve housing(10*a*, 10*b*, 10*c*) and being fastened therein, a check valve (18*a*, 18*b*, 18*c*) with a valve member (37*a*, 37*b*, 37*c*) disposed in the central passage (11*a*, 1l*b*, 11 *c*) adjacent the partition (17*a*, 17*b*, 17*c*), said partition holding the valve member (37*a*, 37*b*, 37*c*) in place.

2. The camshaft adjuster control valve arrangement as claimed in claim 1, wherein the valve housing (10*a*, 10*b*, 10*c*) has a substantially constant wall thickness (15*a*, 15*b*, 15*c*) at least in a partial threaded region (13*a*, 13*b*, 13*c*) and in at least one partial guide region (14*a*, 14*b*, 14*c*).

3. The camshaft adjuster control valve arrangement as claimed in claim 1, wherein the valve housing (10*a*, 10*b*, 10*c*) has over its length a substantially constant outer diameter (16*a*, 16*b*, 16*c*) in at least one partial threaded region (13*a*, 13*b*, 13*c*) and in at least one partial guide region (14*a*, 14*b*, 14*c*).

4. The camshaft adjuster control valve arrangement as claimed in claim 1, wherein the partition (17*a*, 17*b*, 17*c*) and the check valve (18*a*, 18*b*, 18*c*) are at least partially formed in one piece.

5. The camshaft adjuster control valve arrangement as claimed in claim 1, wherein the partition (17*c*) and the check valve (18*c*) are a modular unit which can be mounted in the valve housing (10*c*).

6. The camshaft adjuster control valve arrangement as claimed in claim 1, wherein at least one component is pressed into the valve housing (10*a*, 10*b*, 10*c*) from a side which, in the installed state of the valve housing, faces toward the camshaft (23*a*).

7. The camshaft adjuster control valve arrangement as claimed in claim 1, wherein the valve housing (10*a*, 10*b*, 10*c*)

has at least one integrally formed securing element (20*a*, 20*b*, 20*c*) for securing a control piston (19*a*, 19*b*, 19*c*) within the central passage (11*a*, 11*b*, 11*c*).

8. The camshaft adjuster control valve arrangement as claimed in claim 1, wherein the valve housing (10*a*, 10*b*, 10*c*) has a profile (21*b*, 21*c*) on an inner periphery, which profile (21*b*, 21*c*) is provided for introducing a torque.

* * * * *